US005346409A

United States Patent [19]

Weiner et al.

[11] Patent Number: 5,346,409

[45] Date of Patent: Sep. 13, 1994

[54] FIXABLE ELECTRIC PLUG CONNECTION AND A PROCESS FOR FIXING AN ELECTRIC PLUG CONNECTION

[75] Inventors: Hans Weiner, Mühlacker; Elmar Kloesters, Leonberg, both of Fed. Rep. of Germany

[73] Assignee: Dr. Ing. h.c.F. Porsche AG, Fed. Rep. of Germany

[21] Appl. No.: 11,742

[22] Filed: Feb. 1, 1993

[30] Foreign Application Priority Data

Jan. 31, 1992 [DE] Fed. Rep. of Germany ..... 4202846

[51] Int. Cl.[5] ..... H01R 13/73

[52] U.S. Cl. ..... 439/542; 439/695

[58] Field of Search ..... 439/542, 903, 687, 689, 439/682, 683, 695

[56] References Cited

U.S. PATENT DOCUMENTS

| | | | |
|---|---|---|---|
| 2,677,811 | 5/1954 | Anderson et al. | 439/903 |
| 2,756,402 | 7/1956 | Haworth et al. | 439/687 |
| 4,413,875 | 11/1983 | Mattingly | 439/903 |
| 4,810,207 | 3/1989 | Butterfield | 439/542 |

FOREIGN PATENT DOCUMENTS

| | | | |
|---|---|---|---|
| 1160304 | 1/1984 | Canada | 439/689 |
| 906287 | 3/1954 | Fed. Rep. of Germany . | |
| 8902403 | 6/1989 | Fed. Rep. of Germany . | |
| 2413240 | 12/1977 | France . | |

*Primary Examiner*—Larry I. Schwartz
*Assistant Examiner*—Hien D. Vu
*Attorney, Agent, or Firm*—Evenson, McKeown, Edwards & Lenahan

[57] ABSTRACT

A fixable electric plug connection and a process for fixing an electric plug connection includes two housings which are fitted into one another and which carry corresponding socket and plug contacts. One of the two housings is provided with a surrounding groove which can be locked with a surrounding ridge, for example, in the interior of a stop bolt in order to fix the housing. This provides a space-saving arrangement of the plug connection. The ridge, which is required for the locking of the plug connection, exists in any event as a result of the machining tool operation such that the locking is implemented with simple and low-cost measures.

5 Claims, 1 Drawing Sheet

FIXABLE ELECTRIC PLUG CONNECTION AND A PROCESS FOR FIXING AN ELECTRIC PLUG CONNECTION

BACKGROUND AND SUMMARY OF THE INVENTION

The invention relates to a fixable electric plug connection and a process for fixing the plug connection.

From the German Patent Document DE-G 89 02 403 U1, a cable duct with an electric plug connection is known. In the German Patent Document, a sleeve is provided in an opening of the wall and is connected with the wall. A plug and a coupling are introduced from the outside into the sleeve and, in the plugged-in state, are secured by means of couplings rings which engage in an external thread of the sleeve. However, in this case it is necessary to first fasten the sleeve in the wall before the plug and the coupling can be introduced into the sleeve.

The invention according to the present invention overcomes the problem of providing a fixable electric plug connection which can be fixed by means of simple devices.

The electric plug connection according to the present invention includes two housings which can be fitted into one another. In the housings, socket contacts and plug contacts which are each connected with electric conducting wires are held in a corresponding manner. The first housing is arranged in a through-opening of an elongated component. The outer contour of the first housing largely corresponds to the through-opening. The first housing has a surrounding groove which can be locked in the opening by means of at least one projection.

The principal advantages achieved by the present invention are that the electric plug connection can be fixed only by means of a simple sliding into an opening of an elongated component and a subsequent locking. No additional mounting devices are necessary. Projections in the opening which are required for the locking can easily be made during the forming of the opening by means of machining tools which are necessary anyhow for the forming of the opening. The projections may have any shape that promotes a locking. Furthermore, the plug connection according to the present invention requires only a small number of components.

Other objects, advantages and novel features of the present invention will become apparent from the following detailed description of the invention when considered in conjunction with the accompanying drawings.

DETAILED DESCRIPTION OF THE DRAWINGS

Figure 1:
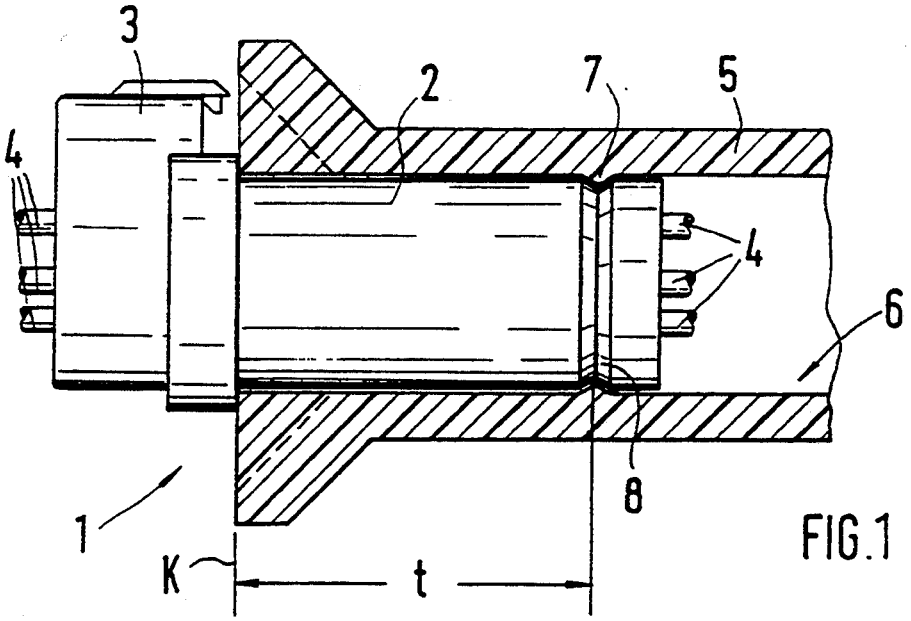
FIG. 1 is a view of an electric plug connection fixed in a stop bolt.

FIG. 1 represents a view of an electric plug connection which comprises a first housing 2 constructed as either a pin plug or socket plug and a second housing 3 constructed as a mating pin plug or a socket plug, respectively. In the housings 2, 3, socket contacts and plug contacts are held (not shown) and are connected with electric conducting wires 4.

The electric plug connection 1 is disposed in an elongated component 5 used as a fastening element, such as a stop bolt, for an exterior mirror of a motor vehicle. The elongated component 5 has a cylindrical through-opening 6. The inside diameter of the opening 6 is selected to be slightly larger than the outside diameter of the first housing 2. At a depth "t" relative to the head surface "K" of the stop bolt 5, the opening 6 has a surrounding ridge 7 which engages with a groove 8 arranged on the first housing 2.

For the mounting of the first housing 2, the electric conducting wires 4, which may possibly already be provided with socket contacts or plug contacts, are pulled through the opening 6 of the stop bolt 5 and are fixed in the first housing 2 in holding devices which are not shown. Then, the first housing 2 is slid into the opening 6 until the groove 8 locks with the ridge 7. The first housing 2 is thus fixed in the stop bolt 5.

Figure 2:
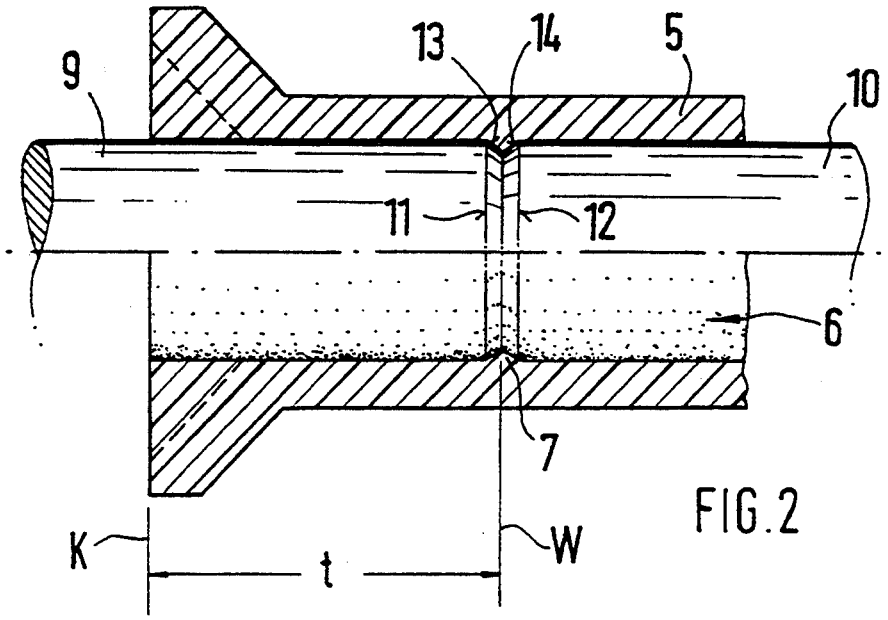
FIG. 2 is a sectional view of the stop bolt during a machining operation.

The stop bolt 5, including the opening 6, is manufactured by means of extruding. As shown in FIG. 2, among others, two machining tools 9, 10, are required, which here are constructed as dies. The dies 9, 10 are pressed from two sides into a blank of the stop bolt 5 until their head surfaces 11, 12 make contact at a depth t. The contact surface of the head surfaces 11, 12 is characterized as a tool junction plane "W". Both head surfaces 11, 12 have surrounding bevels 13, 14 which during the machining produce the ridge 7 at the depth "t".

In the case of the illustrated manufacturing process, it is possible to determine the shape of the ridge 7 by means of the shape of the bevels 13, 14. In addition to the suggested surrounding ridge 7, other shapes are conceivable without impairing the function. The depth "t" in which the ridge comes to rest relative to the head surface "K" of the stop bolt 5 is determined by the tool junction plane "W" and can be adjusted. The ridge 7 may be produced by means of all manufacturing processes which permit a machining or shaping of the opening 6 from two sides.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An electric plug connection for use in a vehicle, comprising:

a socket housing having socket contacts contained therein;

a plug housing having plug contacts contained therein, said socket contacts and plug contacts each being connected with electric conducting wires and being mated with one another when said socket housing and plug housing are fitted to one another; and a one-piece elongated component having only a single through-opening having at lest one projection, one of said socket and plug housings being shaped so as to be insertable into one end of said through-opening, wherein an outer contour of said one housing substantially corresponds to the size of said through-opening and wherein said one housing includes a surrounding groove which can be locked in said through-opening via said at least one projection.

2. An electric plug connection according to claim 1, wherein the at least one projection arranged in the through-opening is constructed as a surrounding ridge.

3. An electric plug connection according to claim 2, wherein the surrounding ridge is produced at a given depth (t) of the through-opening, by forming the through-opening in the elongated component using two-sided machining via machining tools having head surfaces that are each provided with a bevel so that the surrounding ridge is formed at the level of a tool junction plane (W) of the machining tools.

4. An electric plug connection according to claim 1, wherein the through-opening is longer than the first housing.

5. An electric plug connection according to claim 1, wherein the elongated component used as a fastening element.

* * * * *